United States Patent [19]

Swett

[11] 3,957,097

[45] May 18, 1976

[54] SEALED CONTAINER

[75] Inventor: James B. Swett, Altamonte Springs, Fla.

[73] Assignee: Dart Industries Inc., Los Angeles, Calif.

[22] Filed: Feb. 26, 1975

[21] Appl. No.: 553,398

[52] U.S. Cl. ..... 150/0.5; 220/356

[51] Int. Cl.[2] ..... B65D 43/08

[58] Field of Search ..... 150/.5; 220/307, 352, 220/356

[56] References Cited

UNITED STATES PATENTS

| | | | |
|---|---|---|---|
| 3,426,935 | 2/1969 | Swett | 150/.5 |
| 3,487,972 | 1/1970 | Swett | 150/.5 |
| 3,545,642 | 12/1970 | Swett | 150/.5 |
| 3,700,204 | 10/1972 | Swett | 150/.5 |
| 3,719,304 | 3/1973 | Douglas | 150/.5 |

*Primary Examiner*—Ro E. Hart

*Attorney, Agent, or Firm*—Leigh B. Taylor; Paul R. Wylie; Kenneth J. Hovet

[57] ABSTRACT

A container and closure combination wherein the closure includes a stepped ledge area formed by two truncated conical sections that produce a structure resiliency enabling the generation of an effective seal between the mating parts.

8 Claims, 3 Drawing Figures

SEALED CONTAINER

This invention relates to a container wherein both the receptacle or body portion and the closure of the container are substantially rigid and are adapted for holding in food or the like for storage and service. The closure or cover of the container incorporates resiliency and flexibility and is in the form of a plate for receiving or serving the food or other material packaged in the container.

Prior art containers and closures of the general type illustrated by this invention have, among other things, failed to provide a resiliency between the mating parts that would produce a consistently effective hermetic seal. The unique closure construction disclosed here alleviates the noted problems by providing an annular ledge to effect the desired resiliency. The mentioned ledge is angularly disposed such that two truncated cones are produced by the surface sections thereof.

This construction acts as an enlarged hinge to effect the noted resiliency. The prior art, on the other hand, has relied upon only the resiliency in the annular sealing flange itself to produce the seal between closure and receptacle. Here the truncated cones add substantially to the flexibility and/or distensibility of the closure sealing wall, thus affording an increase in effective sealing pressure that may be generated when the closure is in interengagement with the receptacle.

Accordingly, the invention hereinafter described improves upon the type of closuring concept contemplated by U.S. Pat. Nos. 3,081,010; 3,180,541 and 3,181,746. Such disclosures reveal a substantially planar top wall surrounded by a closure skirt. Thus, the degree of seal maintained between the respective parts was dependent upon effect of the skirt and the dimensional accuracy maintained in molding the closure and receptacle.

This invention in some respects reduces the criticality of maintaining such dimensional accuracy. Indeed here with the substantial increase in distensibility of the closure member, the degree of interference between the mating surfaces may be increased. This, of course, also tends to increase the effective sealing pressure.

These and other important objects and advantages of the invention will become more apparent from the following detailed description of a preferred form of the invention when taken in conjunction with the drawings in which.

Figure 1:
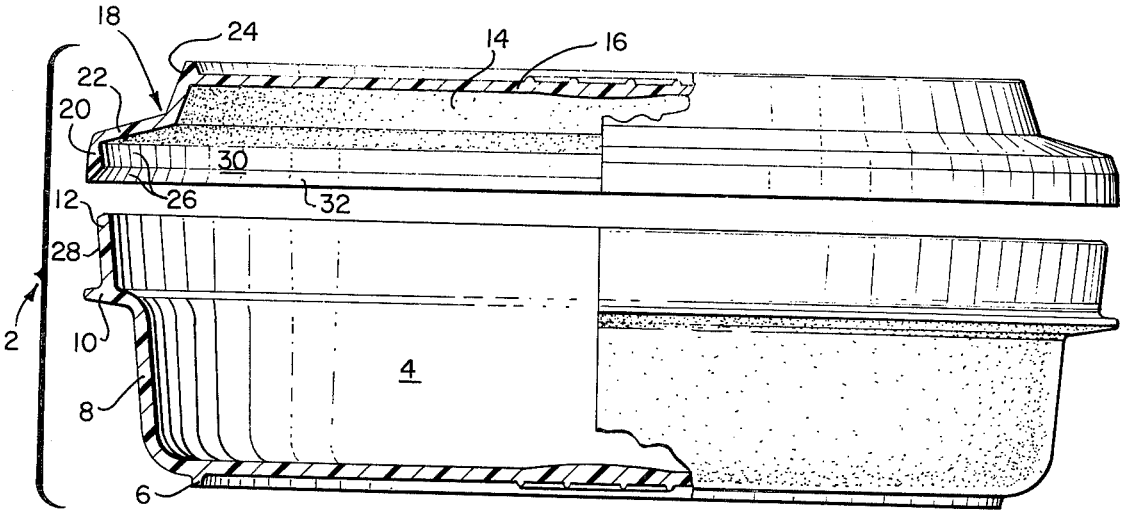
FIG. 1 is an exploded elevational view of the container of the present invention partially in cross-section.
Figure 2:
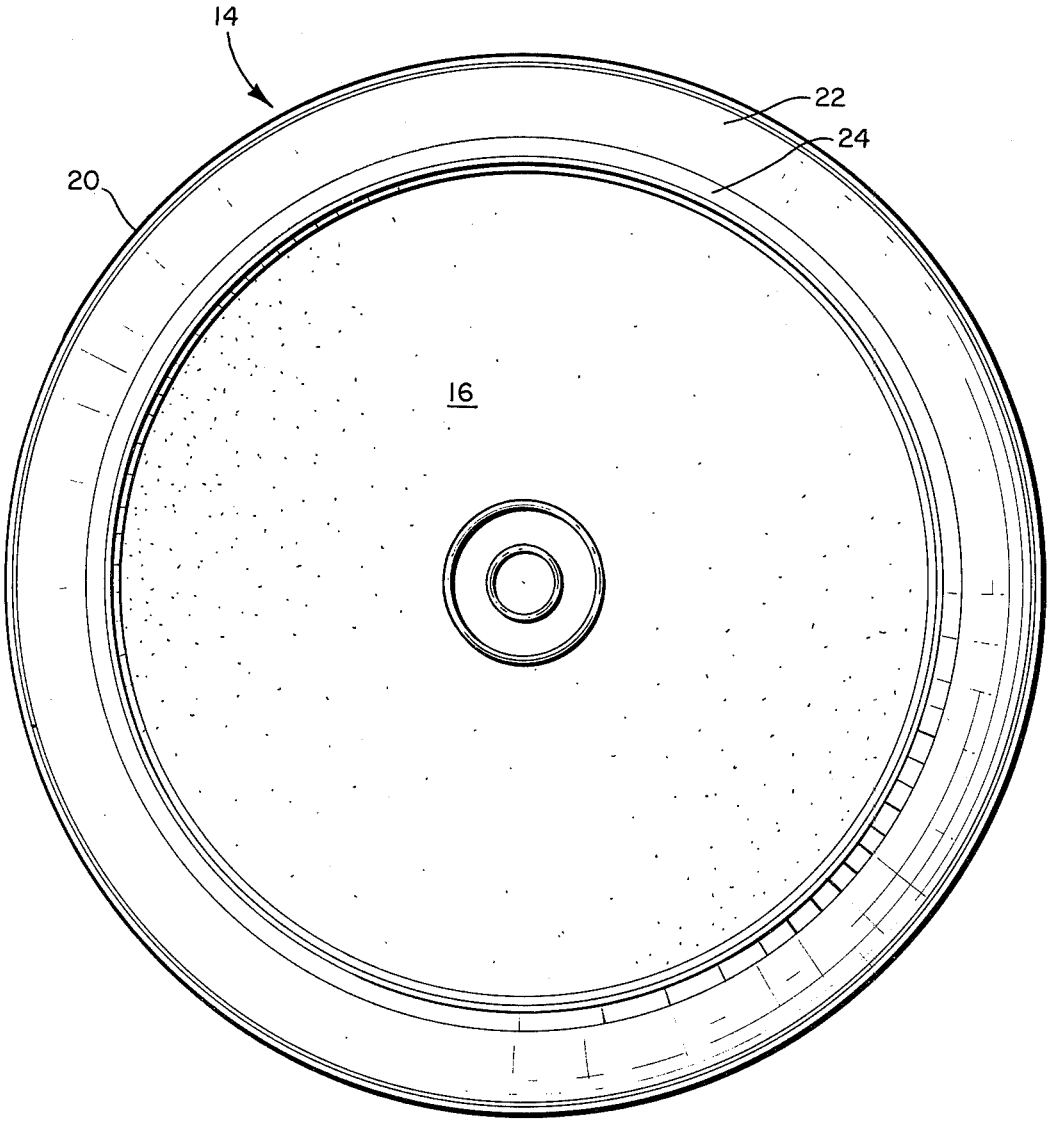
FIG. 2 is a top plan view of FIG. 1.
Figure 3:
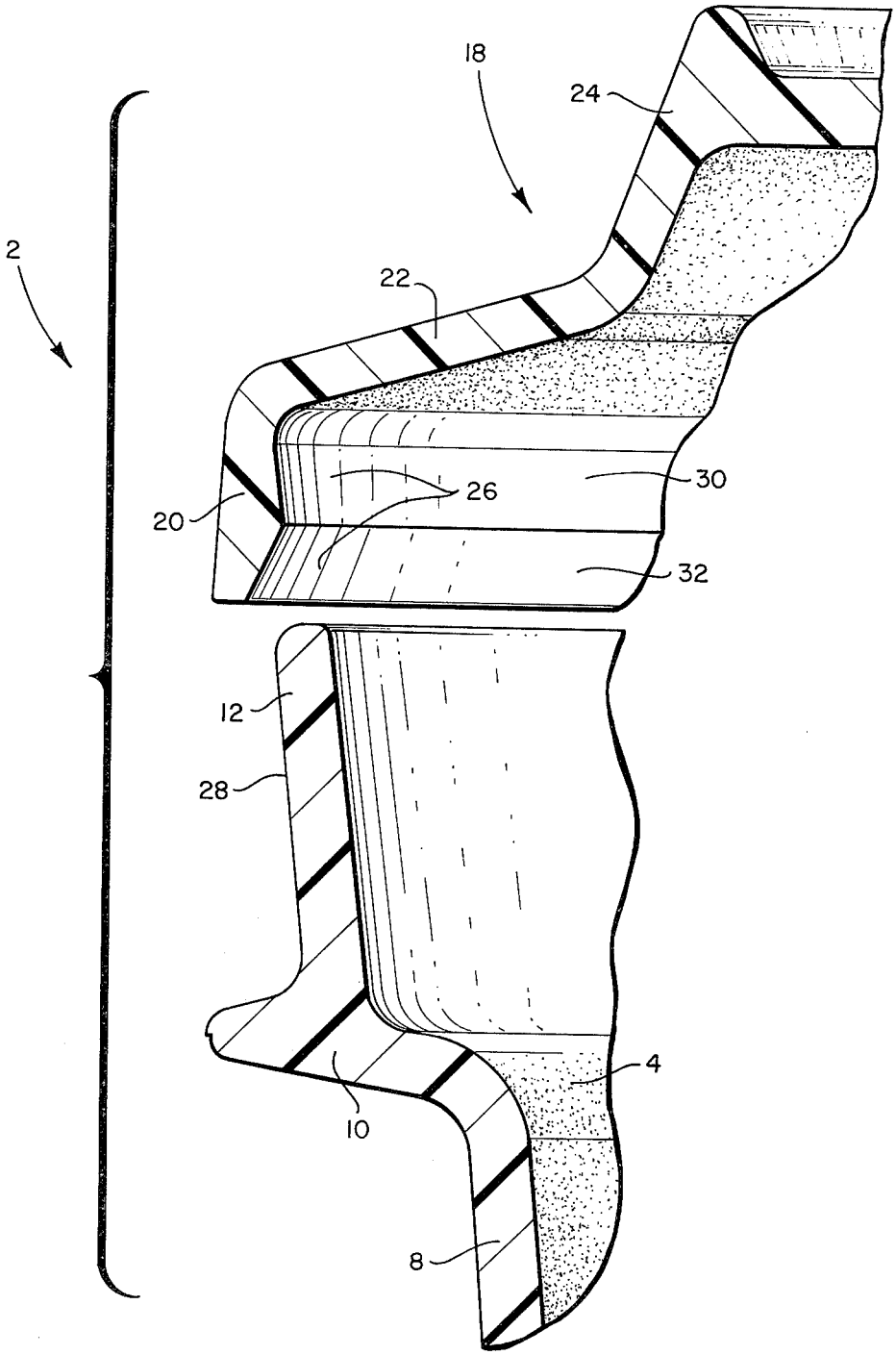
FIG. 3 is an enlarged fragmentary vertical sectional view of FIG. 1.

The container of this invention, generally indicated by the reference numeral 2, includes a receptacle 4 which forms the body portion of the container. The receptacle 4 may be formed of metal, ceramic material, plastic or any other suitable material which is substantially rigid and in which food may be stored.

While the receptacle 4 shown in the drawings is rather shallow and is of circular cross section, it is to be understood that it may have other shapes. The lower surface of the receptacle may be provided with an annular rib 6 for supporting the lower surface of the receptacle a short distance above the surface on which it is placed.

The receptacle, of course, is completed by a side wall portion 8 that extends upwardly to a substantially horizontally extending flange area 10 and above which is located an integral terminal edge portion 12 that extends entirely around the periphery thereof. The receptacle 4 is preferably round as observed in plan view with the terminal edge portion 12 extending laterally outwardly thereof at an angle of between about 3° and 8° from the vertical. Preferably the angle of divergence of portion 12 is about 6°.

The closure 14 of the container 2 may be employed as a plate for serving the contents of the container after being removed from the receptacle and inverted. As shown, the closure includes a generally planar top wall area 16 that occupies between about 60 and 70 percent of the total planar area circumscribed by the closure 14. Substantially all of the remainder of the areas circumscribed by the closure is occupied by ledge 18, and the downwardly projecting skirt or sealing wall 20.

The ledge 18 is further formed by first and second truncated conical sections 22 and 24, respectively. The truncated conical section 22 projects inwardly and upwardly from the wall 20 at between about 10° and 20° from the horizontal. Preferably such angle of projection is maintained at about 15° to, in conjunction with the second conical section 24, produce the desired resiliency in a high density polyethylene closure. Likewise, the second conical section 24 is maintained at between about 10° and 20° from the vertical as it extends between its juncture with the first such section and the top wall area 16.

As is noted above, the planar area of closure top wall area 16 occupies a substantial portion of the total planar area circumscribed by the entirety of the closure 14. It is possible, of course, to reduce this percentage value by increasing the radial extent of either or both of the truncated conical sections 22 and 24. However, such variations it is theorized will significantly affect the rigidity of the closure. Thus, the effective sealing pressure between the closure 14 and receptacle 4 will also be significantly affected by the variance and it is anticipated that a reduction below that indicated to be preferable will result in an ineffective seal.

It should be appreciated that the truncated conical sections 22 and 24 provide to the closure top wall an ability to flex and expand the planar area circumscribed by the closure. This deformation further enables the closure to ride down and over terminal edge portion 12 of the container and thereafter attempt to return to its original undeformed size. As the top wall area 16 of the closure 14 is depressed in mating it to receptacle 4, the truncated conical sections 22 and 24 act as a hinge member. Thus as pressure is applied, truncated conical section 22 tends to go into a horizontal position which, in turn, forces skirt 20 to a distended state. This distension, of course, allows for the closure 14 to assume its sealing relationship with receptacle 4. Then as the closure returns toward its original undeformed size, the inside surface 26 of sealing wall 20 is drawn into intimate hermetic sealing contact with the outer surface 28 of terminal edge portion 12.

To further promote a proper seal and to assist in assembly of the respective parts, i.e. container and closure, the inside surface 26 of skirt 20 extends downwardly from the lower edge of the first conical section 22 and includes a first wall area 30 which extends downwardly and inwardly at a small angle from the lower edge of the section 22 and a second wall area 32 which extends downwardly and outwardly at a small angle from the lower edge of the first wall area 30 so as to provide with the first wall area a generally V-shaped protrusion 34.

Accordingly, the angular relationship of the second wall area 32 enables the user to have easily started the appropriate assembledge of the closure 14 upon the receptacle 4. In this respect it should be noted that the user, in applying the closure, will have initially positioned the closure 14 on the receptacle 4 so that one side of closure sealing wall 20 is in a final assembled (i.e. sealing) relationship with the receptacle wall surface 28. Thereafter, as pressure is applied to the closure top wall area 16 with the heel or thumbs of the users hands the opposite side may be simultaneously lifted with the finger digits to distend wall 20. As indicated above, this distension enables proper placement of the closure 14 on the receptacle and the hermetic seal is effected between surfaces 28 and 30.

Placement of the closure 14 upon receptacle 4 in the manner described also tends to simultaneously evacuate the maximum amount of air from the container interior. Accordingly, it is unnecessary to "burp" the container 2 after its assembledge and the user is spared this extra procedural step in perfecting the storage conditions for the product retained in the container.

The internal diameter of the generally V-shaped protrusion 32 is at least as small as and preferably several thousandths of an inch smaller, that is up to seventy thousandths, than the outer diameter of the terminal edge portion 12 of the container 4. Thus, there is substantial frictional engagement with the exterior surface of the wall 20 when the cover is in the lowered and sealing position. Furthermore, due to the fact that the user will have one side of the closure in place before completing the seal, the required amount of closure distension will be substantially less than the noted difference suggested by the diametric discrepency between container parts.

As noted above the preferred material of construction for both the container 4 and closure 14 is high density polyethylene. However, other plastics such as polypropylene may be used with equal effectiveness.

While a preferred form of the invention has been described and disclosed above, it is to be understood that such changes and alterations as would occur to those skilled in the art are to be considered with the purview of this invention as fall within the scope of the appended claims.

What I claim is:

1. A storage vessel comprising in combination a hermetically interengaged container and container closure of like polymeric materials wherein said container includes a sidewall having an upper terminal edge portion that protrudes outwardly from the vertical at between about 3° and 8°; and said closure includes a downwardly disposed skirt having an inside surface a first portion of which, in its molded condition, is dimensionally smaller than the terminal edge portion of said container and is angularly disposed from the vertical at about between 3° and 8° in congruency with said terminal edge portion so as to pressingly mate therewith, said container closure further incorporating a ledge portion that extends inwardly and upwardly from the upper extremity of said lip first at an angle of between about 10° and 20° from the horizontal and thereafter at an angle of between about 10° and 20° from the vertical, and a substantially planar top wall integrally attached to said ledge portion proximate the inner extremity thereof.

2. A storage vessel according to claim 1 wherein said planar top wall occupies between about 60 and 70 percent of the total planar area circumscribed by said container closure.

3. A storage vessel according to claim 1 wherein the polymeric material is characteristically rigid, in its as molded condition, and is selected from the group comprised of polypropylene, high density polyethylene and polyallomer.

4. A storage vessel according to claim 1 wherein the inside surface of said downwardly disposed skirt includes a second portion intersecting said first portion.

5. A storage vessel according to claim 4 wherein said second portion angles outwardly from its intersection with said first portion.

6. A storage vessel comprising in combination a hermetically interengaged container and container closure of like polymeric materials wherein said container includes a sidewall having an upper terminal edge portion that protrudes outwardly from the vertical at about 6°; and said closure includes a downwardly disposed skirt having an inside surface a first portion of which, in its molded condition, is dimensionally smaller than said terminal edge portion and is angularly disposed from the vertical at about 6° in congruency with said edge portion so as to pressingly mate therewith, said container closure further incorporating a ledge portion that extends inwardly and upwardly from the upper extremity of said lip first at an angle of about 15° from the horizontal and thereafter at an angle of about 15° from the vertical, and a substantially planar top wall integrally attached to said ledge portion proximate the inner extremity thereof.

7. A storage vessel according to claim 6 wherein said planar top wall occupies about 65 percent of the total planar area circumscribed by said container closure.

8. A storage vessel comprising in combination a hermetically interengaged container and container closure of like polymeric materials wherein said container includes a sidewall having an upper terminal edge portion that protrudes outwardly from the vertical at about 6°; and said closure includes a downwardly disposed lip having an inside surface a first portion of which, in its molded condition, is dimensionally smaller than said terminal edge portion and is angularly disposed from the vertical at about 6° in congruency with said edge portion so as to pressingly mate therewith, said container closure further incorporating a ledge portion that extends inwardly and upwardly from the upper extremity of said lip at an angle of about 15° from the horizontal and a substantially planar top wall integrally attached to said ledge portion proximate the inner extremity thereof.

* * * * *